United States Patent [19]

Divis

[11] 4,327,748

[45] May 4, 1982

[54] SMOKING DEVICE HOLDER

[76] Inventor: George F. Divis, 109 W. Chicago, Algonquin, Ill. 60102

[21] Appl. No.: 226,064

[22] Filed: Jan. 19, 1981

[51] Int. Cl.[3] ..... A24F 13/02; A24F 13/04

[52] U.S. Cl. ..... 131/187; 131/198 R; 131/206; 131/215 B; 131/223; 131/198 A

[58] Field of Search ..... 131/187, 206, 215, 215 B, 131/223, 329, 330, 338, 270, 271, 272, 198, 198 A

[56] References Cited

U.S. PATENT DOCUMENTS

| | | | |
|---|---|---|---|
| 2,110,670 | 3/1938 | Johnson | 131/223 |
| 2,788,005 | 4/1957 | Gustafsson | 131/175 |
| 3,058,476 | 10/1962 | Atkins | 131/198 X |
| 3,685,522 | 8/1972 | Klenhans | 131/215 B |

*Primary Examiner*—Stephen C. Pellegrino
*Attorney, Agent, or Firm*—Mathew R. P. Perrone, Jr.

[57] ABSTRACT

A smoking device holder includes a device receiver secured to a smoking mouthpiece with a hand-operated valve located within the smoking device receiver for the purpose of controlling smoking by adjusting, reducing, or eliminating the smoke consumed by the smoker.

10 Claims, 5 Drawing Figures

SMOKING DEVICE HOLDER

BACKGROUND OF THE INVENTION

This invention relates to a holder for a smoking device, and more particularly to holder for a smoking device having a valve for controlling the smoke actually consumed by the smoker by adjusting the smoke flow to the smoker and mixing the smoke with air.

Extensive medical and scientific research over the past years completely and thoroughly confirms the harm caused by smoking. The greatest harm from smoking is generally caused by cigarettes, although cigars and pipes have their detrimental aspects also. This harm generally occurs as some form of cancer, although emphysema and other problems are attributable at least in part to smoking.

In spite of such well-documented research, people continue to smoke. In fact, there are at least fifty million adult smokers in the United States. Without the warning label required on each package of cigarettes by the Surgeon General of the United States, it is estimated that the number of adult smokers in the United States might approach seventy five million.

Of the people still continuing to smoke in the face of all the dire predictions, it is estimated that at least sixty percent fall into realm of those who have tried to quit smoking. It is also estimated that four out of five smokers who have tried to quit have failed to achieve their goal. Such a high failure rate indicates the psychological dependence of smokers on their cigarettes or other smoking devices, and further indicates the complexities involved in trying to quit smoking.

In recognition of this psychological phenomenon and other problems connected with smoking, researchers are greatly involved in the development of devices to simplify or help alleviate the pschological and physical problems involved with the controlling the smoking habit—even to the point of reducing smoke intake or stopping smoking entirely.

It is recognized that some of the problems, both physical and psychological, associated with smoking are due to the amount of smoke consumed or taken into the lungs, and the temperature of the smoke so consumed. Accordingly, many devices are known that cool the smoke or reduce the amount of available smoke consumed.

One basic way to reduce the temperature of the smoke consumed is to mix the smoke with ambient air. Implements that permit such mixing of air with the smoke are generally complicated and have many parts, which are not necessarily controlled by the smoker with relative ease.

Likewise, implements which reduce the amount of smoke reaching the smoker and permit the smoke to be harmlessly burned off without reaching the smoker, are equally cumbersome to both use and control. Yet controlling or adjusting the amount of smoke received is desirable for assisting the smoker in reducing the harm smoking does or assisting the smoker to become a non smoker.

It is, therefore, desirable to provide a smoking device which accomplishes these desirable goals with a minimum amount of complication.

SUMMARY OF THE INVENTION

Therefore, it is an object of this invention to provide a smoking device holder capable of adjusting the smoke flow to the smoker.

A further object of this invention is to provide a smoking device holder capable of mixing air with smoke.

A still further object of this invention is to provide a smoking device holder having a simpler adjustment for smoke flow from a smoking device.

Also, an object of this invention is to provide a smoking device holder which assists the smoker in reducing the amount of smoking the smoker does.

Another object of this invention is to provide a smoking device holder which will assist the smoker to quit smoking.

Still another object of this invention is to assist the smoker in overcoming the physical problems caused by smoking.

Yet another object of this invention is to assist the smoker in overcoming the psychological problems caused by smoking.

A further object of this invention is to provide a device which can control the amount of smoke reaching the smoker without substantial hindrance to smoking enjoyment.

These and other objects of this invention are met by providing a smoking device holder having a device receiver secured to a mouthpiece, wherein smoking device receiver includes therein a valve for adjusting the amount of smoke received by the smoker.

BRIEF DESCRIPTION OF THE DRAWING

Throughout the figures of the drawing, said drawing and said figures being a part of this specification and disclosure, the same numeral refers to the same part, even though the numeral and part may appear a plurality of times in different figures.

DESCRIPTION OF THE PREFERRED EMBODIMENTS

Figure 1:
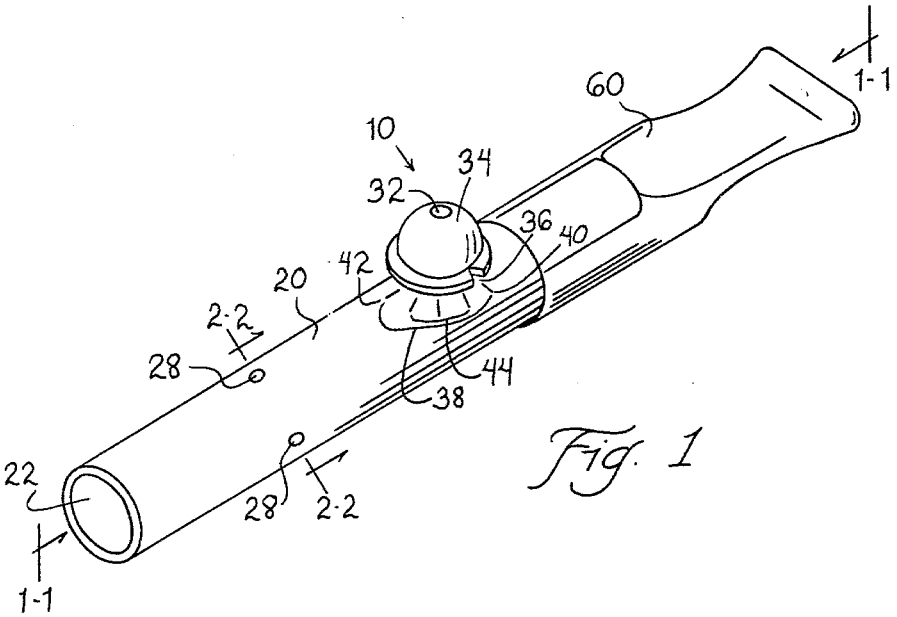
FIG. 1 depicts a perspective view of smoking device holder 10.
Figure 2:
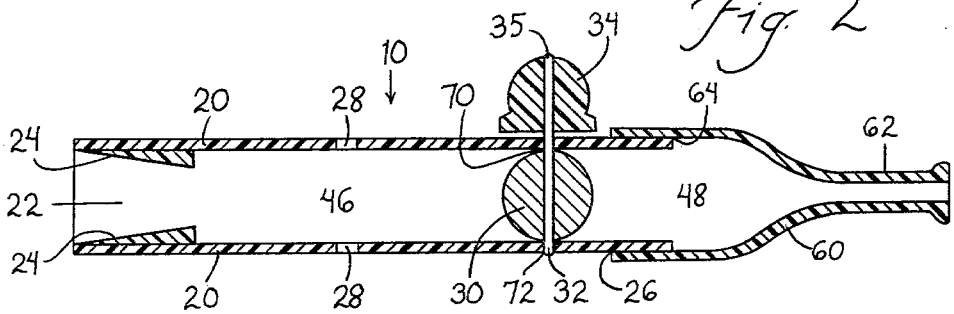
FIG. 2 depicts a cross-sectional, lengthwise view of the smoking device holder 10 along line 1—1 except that valve 30 is in open position 56.

While the smoking device holder of this invention may assume various shapes and configurations in accordance with this invention, the device holder as depicted and described sets out a preferred device holder of this invention. The smoking device holder 10 of this invention, which is suitable for providing controlled smoking for the smoker, generally includes a smoking device receiver 20 secured to a mouthpiece 60 as shown in FIG. 1. By smoking device is meant a cigarette, a cigar, a pipe, or other smoking device desirably mated to the smoking device holder 10 of this invention.

At one end of smoking device receiver 20, is a device receiving end 22, having secured on the interior of device receiver 20 at device receiving end 22, a smoking device securing holder 24. It is smoking device securing holder 24 which actually receives and holds the smoking device to be placed in smoking device holder 10. Securing holder 24 may be modified in any suitable fashion to hold a cigar, pipe, or other smoking device. Securing holder 24 as shown is suitable for cigarettes.

At the other end of smoking device receiver 20 is mouthpiece receiving end 26, whereby smoking device receiver 20 mates with mouthpiece 60 in a male female relationship. Of course, it is possible for device receiver 20 and mouthpiece 60 to be all one unit. Separate pieces are shown for ease of discussion and description.

Transverse air apertures 28 in smoking device receiver 20 permit air to enter smoking device receiver 20. Apertures 28 are shown to be four in number, which is preferred but changeable. Apertures 28 are between device receiving end 22 and valve 30. Valve 30 serves to control the smoke reaching the smoker. Valve 30 is mounted on the interior of smoking device receiver 20 and is secured to valve mounting rod 32. Valve mounting rod 32 is secured in smoking device receiver 20 and passes completely therethrough. Valve control knob 34 is mounted on knob end 35 of valve mounting rod 32, and as such, valve control knob 34 is on the exterior of smoking device receiver 20. Thus knob end 35 of valve mounting rod 32 extends on the exterior of smoking device 20.

Knob indicium 36 is formed on valve control knob 34 by notching or otherwise marking valve control knob 34. In the preferred embodiment shown, knob indicium 36 appears on valve control knob 34 in standard plumbing fashion, in order to show the closed and opened positions.

Figure 3:
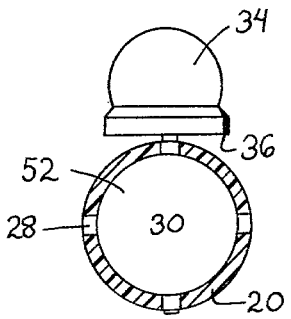
FIG. 3 depicts a cross-sectional view of smoking device holder 10 along line 2—2, with valve 30 in closed position 52.
Figure 4:
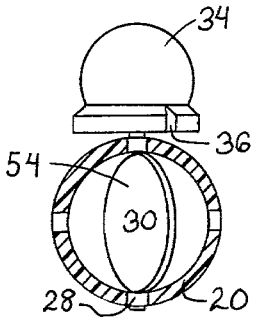
FIG. 4 depicts the same view as FIG. 3, but with valve 30 in a partially closed position 54.
Figure 5:
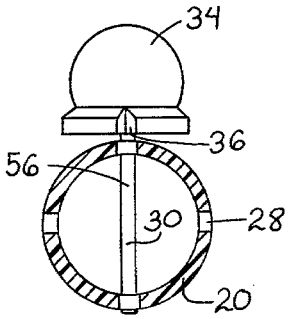
FIG. 5 depicts the same view as FIG. 3, but with valve 30 in a completely open position 56.

To cooperate with knob indicium 36, there are optionally a plurality of receiver indicia 38 on the exterior of device receiver 20, and indicate the position of valve 30 within smoking device receiver 20. Included in receiver indicia 38, is a closed indicium 40 for showing valve 30 in closed position 52 of FIG. 3, when knob indicium 36 and closed indicium 40 are aligned. Also open indicium 42 when aligned with knob indicium 36 places valve 30 in open position 56 of FIG. 5. There are also a plurality of intermediate indicia 44 between open indicium 42 and closed indicium 40 to indicate a plurality of partially closed positions for valve 30. A particular partially closed position 54 is shown in FIG. 4. The various positions of valve 30 controlled by valve mounting rod 32 being rotatably secured in device receiver 20 control the amount of smoke reaching the smoker.

The reason that receiver indicia 38 are optional is that knob indicium 36 may be used like a plumbing valve, such that when knob indicium 36 is aligned with smoking device receiver 20, valve 30 is open; and when knob indicium 36 is aligned perpendicularly to the horizontal axis of the smoking device receiver 20, valve 30 is closed. Intermediate thereto, valve 30 is partially closed such as is shown partially closed position 54 in FIG. 4.

Between valve 30 and device receiving end 22 on the interior of smoking device receiver 20, is mixing chamber 46. Air coming through air apertures 28 mixes with smoke from a smoking device inserted in device holder 24 in mixing chamber 46. In this manner the smoke can be cooled and thereby rendered less harmful.

Between mouthpiece 60 and valve 30 is a mixture receiving chamber 48 which receives the mixture of air and smoke which is permitted to pass valve 30, and through mouthpiece 60 into the smoker's mouth. If valve 30 is in closed position 52, substantially no smoke can enter the smoker's mouth, because valve 30 substantially completely isolates mixture receiving chamber 48 from mixing chamber 46. The amount of smoke entering the smoker's mouth depends on the position of valve 30. If valve 30 is in partially closed position 54, part of the smoke and air mixture is allowed to pass through mixing chamber 46 into mixture receiving chamber 48, and thence into the smoker's mouth. Thus, by positioning valve 30 by hand, the smoker can control the amount of smoke received.

Mouthpiece 60 mates with smoking device receiver 20 at a receiver mating end 64 of mouthpiece 60 and mouthpiece receiver end 26 of smoking device receiver 20. Mouthpiece 60 has opposite receiver mating end 64, a tapered mouth end 62 of standard designed to fit comfortably in the mouth of a a smoker. Of course, mouthpiece 60 and smoking device receiver 20 can be unitary by a simple modification of a molding process. Mouthpiece 60 cooperates in a secured fashion to form mixture receiving chamber 48.

Valve mounting rod 32 may be secured in smoking device receiver 20 in any suitable fashion. In one embodiment, mounting rod 32 is frictionally but rotatably secured in smoking device receiver 20 through a knob mounting rod aperture 70 adjacent knob 34 and a base mounting rod aperture 72. Knob mounting rod aperture 70 is diametrically opposed to base mounting rod aperture 72. Thus rod 32 passes through smoking device receiver 20 and is held in place due to valve 30 being secured thereto within smoking device receiver 20. Valve 30 is of sufficient size and resiliency to to assume any desired position such as closed position 52, partially closed position 54, and open position 56.

In operation, holder 10 receives a smoking device (not shown) in device holder 24. Smoke passes from the lit smoking device into mixing chamber 46 where the smoke mixes with air which enters mixing chamber 46 through apertures 28. If valve 30 is at least partially open such as shown by partially closed position 54, smoke can enter mixture receiving chamber 48 and pass to the smoker through mouth end 62 of mouth piece 60. If valve 30 is in closed position 52, smoke does not reach the smoker, while holder 10 still permits the smoker to have some enjoyment without all the side effects.

Holder 10, valve 30 and other parts hereof may be made of any suitable material which is not chemically reactive with the smoking device or the smoke therefrom to produce a harmful result, and impervious to the high temperatures inherent in a smoking device. These materials may be plastic, synthetic resin, metal, or other material having the desired characteristics while at the same time being capable of shaping to form smoking device holder 10. Valve 30 may be made of any solid or resilient material which can carry out the desired result of being rotatably mounted within the smoking device receiver 20 and capable of closing smoking device receiver 20 in order to completely or partially block the smoke flow to the smoker as desired.

Both mixing chamber 46 and mixture receiving chamber 48 may be at least partially filled with standard filter type material common in the smoking art, so long as the filter material does not interfere with smoking device 10.

What is claimed and sought to be secured by Letters Patent of the United States is:

1. A smoking device holder for controlling an amount of smoke received by a smoker comprising:

a. a smoking device receiver secured to a smoking mouthpiece;
b. a device receiving means at a first end of said smoking device receiver;
c. a device holding means in said first end;
d. a mouthpiece receiving end at a second end of said smoking device receiver secured to and mating with said mouthpiece;
e. a valve means between said first end and said second end;
f. a mixing chamber for the mixing of smoke and air within said smoking device receiver and between said first end and said valve means;
g. an adjusting means for said valve means;
h. at least one transverse air means in said smoking device receiver between said valve means and said first end;
i. said air means communicating with said mixing chamber; and
j. said valve means being capable of partially or completely closing said smoking device receiver.

2. The smoking device holder of claim 1 wherein:
a. said valve means is partially rotatable within said smoking device receiver;
b. a marking means for indicating an open position, a closed position, and a partially closed position for said valve on said adjusting means.

3. The smoking device holder of claim 2 wherein said marking means cooperates with at least one indicium on said smoking device receiver to indicate the position of said valve means.

4. The smoking device holder of claim 3 wherein said indicia include a closed position indicium, an open position indicium, and at least one intermediate indicium.

5. The smoking device holder of claim 5 wherein a mixture receiving chamber is within said smoking device holder and between said valve means and said mouthpiece, and said valve means controls the amount of smoke and air passing into said mixture receiving chamber.

6. The smoking device receiver of claim 5 wherein said adjusting means is a knob and said marking means is a notch on said knob.

7. The smoking device holder of claim 6 wherein a valve mounting rod is secured within said smoking device receiver at a knob mounting rod aperture and a base mounting aperture diametrically opposed to to said knob mounting rod aperture.

8. The smoking device holder of claim 7 wherein said valve is secured to said valve mounting rod.

9. The smoking device holder of claim 8 wherein said knob is secured to said valve mounting rod adjacent said knob mounting aperture.

10. The smoking device holder of claim 9 wherein said device holding means is adapted to receive a cigarette.

* * * * *